US008181272B2

(12) United States Patent
Lee

(10) Patent No.: US 8,181,272 B2
(45) Date of Patent: May 22, 2012

(54) DISPOSABLE, CONTOURED PAPER LIKE DEVICE TO ABSORB LIQUID AND SMALL SOLID MATERIAL FROM ORAL DISCHARGE

(75) Inventor: Debra L. Lee, Atherton, CA (US)

(73) Assignee: luxebaby, LLC, Redwood City, CA (US)

( * ) Notice: Subject to any disclaimer, the term of this patent is extended or adjusted under 35 U.S.C. 154(b) by 0 days.

(21) Appl. No.: 12/784,375

(22) Filed: May 20, 2010

(65) Prior Publication Data

US 2010/0293693 A1 Nov. 25, 2010

Related U.S. Application Data

(60) Provisional application No. 61/180,183, filed on May 21, 2009.

(51) Int. Cl.
*A41D 13/04* (2006.01)

(52) U.S. Cl. ..... 2/46; 2/48

(58) Field of Classification Search ..... 2/46, 48, 2/104, 50, 52, 49.1, 49.2, 49.4, 49.5, 51, 2/60, 91, 92, 207; D2/861, 860
See application file for complete search history.

(56) References Cited

U.S. PATENT DOCUMENTS 1,979,879 A * 11/1934 May ..... 2/48
2,258,946 A 10/1941 Chadwick
2,482,182 A * 9/1949 Henninger ..... 2/48
2,492,599 A * 12/1949 Smith ..... 2/49.1
2,523,565 A * 9/1950 Gardner ..... 2/49.1
2,563,420 A * 8/1951 Roe ..... 2/48
2,654,092 A * 10/1953 Brennish ..... 2/50
2,727,239 A * 12/1955 Simon ..... 2/49.2
2,831,193 A * 4/1958 Terry ..... 2/46
(Continued)

OTHER PUBLICATIONS

Chiparus, 0.1., Bagasse Fiber for Production of Nonwoven Materials. A Dissertation 2-4 Submitted to the Graduate Faculty of the Louisiana State University and Agricultural and Mechanical College in partial fulfillment of the requirements for the degree of Doctor of Philosophy in The School of Human Ecology [online} May 2004. [Retrieved on Sep. 8, 2010) Retrieved from the Internet:<URL: http:/ letd.lsu.edu/docs/available/etd-02262004-111054/unrestricted/ Chiparus_dis.pdf; pp. 1-2, 13-14.

*Primary Examiner* — Amy Vanatta
(74) *Attorney, Agent, or Firm* — Patent Law Offices of Michael E. Woods; Michael E. Woods

(57) ABSTRACT

A method and apparatus for an environmentally-friendly disposable product and method that permits a caretaker to easily deploy and accurately position the product with confidence that the product is hygienic, effective in efficiently protecting the caretaker's clothing, and resistant to repositioning. The apparatus for overlaying a shoulder of a user includes a generally elongate absorbent soak-resistant body element including a front portion, a rear portion and an intermediate portion joining the front portion to the rear portion, the body element shaped for deployment over the shoulder with the intermediate portion generally disposed on top of the shoulder having the front portion overlaying a portion of a chest of the user and having the rear portion overlaying a portion of a back of the user; and a retentive element coupled to the body element, the retentive element interacting with the user to resist displacement of the body element after the body element is deployed over the shoulder.

3 Claims, 4 Drawing Sheets

U.S. PATENT DOCUMENTS 2,955,293 A * 10/1960 Peterson ..... 2/48
3,857,116 A * 12/1974 Meeker ..... 2/50
3,945,048 A * 3/1976 Shearer ..... 2/48
4,980,927 A * 1/1991 Wawiluk et al. ..... 2/60
D340,124 S * 10/1993 Paxton ..... D2/860
5,432,952 A * 7/1995 Tate ..... 2/49.4
5,459,877 A 10/1995 Roberti
D375,187 S * 11/1996 Shoemate ..... D2/861
5,572,740 A * 11/1996 Geniesse ..... 2/46
5,956,763 A * 9/1999 Blackshear ..... 2/49.1
5,991,919 A * 11/1999 Baggetto ..... 2/50
6,094,744 A * 8/2000 Dibenedetto et al. ..... 2/50
6,385,774 B1 * 5/2002 Rodgers ..... 2/50
D482,846 S * 12/2003 Miller ..... D2/861
7,080,413 B1 * 7/2006 Schneider ..... 2/60
2007/0050890 A1 3/2007 Purnell
2008/0102261 A1 * 5/2008 Hupp et al. ..... 428/218
2008/0201815 A1 * 8/2008 Barclay ..... 2/48
2008/0263740 A1 * 10/2008 Wright et al. ..... 2/49.1
2009/0089910 A1 * 4/2009 Lopez ..... 2/52
2009/0300815 A1 * 12/2009 Nunez ..... 2/50

* cited by examiner

DISPOSABLE, CONTOURED PAPER LIKE DEVICE TO ABSORB LIQUID AND SMALL SOLID MATERIAL FROM ORAL DISCHARGE

CROSS REFERENCE TO RELATED APPLICATIONS

This application claims the benefit of U.S. Provisional Application No. 61/180,183, filed 21 May 2009, the contents of which are expressly incorporated herein in their entirety for all purposes.

BACKGROUND OF THE INVENTION

The present invention relates generally to a contoured paper like device to absorb liquid and to collect small solid material from bodily discharge.

People in general, but babies in particular, are particularly subject to accumulation of gas in the stomach while feeding. This gas accumulation famously can cause considerable discomfort and/or agitation in a baby. One well-known solution for this gas accumulation is to "burp" the baby. There are many techniques, but in general the act of burping an infant involves placing the child in a position conducive to gas expulsion (e.g., holding the infant up to the caretaker's shoulder, with the baby's stomach resting on the caretaker's chest) and then lightly patting the baby on its lower back so that it burps. Burping in a baby is typically associated with vomiting. To avoid contamination of the caretaker's clothing, a burp cloth or burp pad is sometimes used on the shoulder as a barrier. Typically this used burp cloth is carried around for further later use until deemed unfit, then it is stored until it may be laundered and available to be reused. (The use of a cloth diaper is often recommended for a burp cloth.) This scenario can create an unhealthy situation for the baby and the caretaker, and in cases where the heath is not actually endangered, it can create an unpleasant environment due to the odors and requirements to maintain proper storage.

One solution sometimes used is to dispose of the burp cloth after a few uses. The caretaker typically balances trying to gain "sufficient" use from the burp cloth against development of an unpleasant/unhealthy environment resulting from storage and use of a soiled burp cloth. There is the further concern of burp cloths filling landfills or contaminating the environment because they are not designed for environmentally-friendly disposal.

Yet another concern associated with burp cloths is that, due to the very nature of burping, the timing of feeding and subsequent burping is not always convenient for the caretaker. The baby may need to be burped when the caretaker and baby are in a public setting. It is not always appropriate for the caretaker to position an unsightly, potentially unsanitary conventional burp cloth on their shoulder in some public venues.

Further, the caretaker may decide to burp the baby when the caretaker is wearing clothing that could be damaged should the baby vomit during burping, or they are burping the baby at a time when it would be inconvenient or relatively difficult to change clothing in the event that some discharge contaminates their clothing in spite of efforts to use a burp cloth.

Some burp cloths are not designed to help the caretaker adequately protect their clothing, either the size is not right, the shape leaves some at-risk areas exposed, or the baby may inadvertently reposition the burp cloth before burping.

Some of these concerns are shared in the broader context of caretakers-at-large (including medical and health care personnel and the like) that care for people, young or old.

What is needed is an environmentally-friendly disposable product and method that permits a caretaker to easily deploy and accurately position the product with confidence that the product is hygienic, effective in efficiently protecting the caretaker's clothing, and resistant to repositioning.

BRIEF SUMMARY OF THE INVENTION

Disclosed is a method and apparatus for an environmentally-friendly disposable product and method that permits a caretaker to easily deploy and accurately position the product with confidence that the product is hygienic, effective in efficiently protecting the caretaker's clothing, and resistant to repositioning. The apparatus for overlaying a shoulder of a user includes a generally elongate absorbent soak-resistant body element including a front portion, a rear portion and an intermediate portion joining the front portion to the rear portion, the body element shaped for deployment over the shoulder with the intermediate portion generally disposed on top of the shoulder having the front portion overlaying a portion of a chest of the user and having the rear portion overlaying a portion of a back of the user; and a retentive element coupled to the body element, the retentive element interacting with the user to resist displacement of the body element after the body element is deployed over the shoulder.

The method includes the steps of: (a) deploying a generally elongate absorbent soak-resistant body element over a shoulder of a user at a deployment position, the body element including a front portion, a rear portion and an intermediate portion joining the front portion to the rear portion, the body element shaped for deployment over the shoulder with the intermediate portion generally disposed on top of the shoulder having the front portion overlaying a portion of a chest of the user and having the rear portion overlaying a portion of a back of the user; and (b) interacting a retentive element, the retentive element coupled to the body element, with the user to resist displacement of the body element from the deployment position.

In contrast to preferred embodiments of the present invention, many products currently available on the market are not disposable and packaged individually for single use. Many other products are generally reused by laundering the soiled material. Before it can be laundered, the product is unsanitary as it becomes a reservoir for harboring microbes that are unhygienic and may also produce unpleasant odors. In the presence of infants or young children, this can become a health hazard. They are not made of environmentally friendly materials that are sanitized and sterilized as is the case in the processing of the preferred embodiments of the present invention. The prior art products are often not compostable or biodegradable. Preferred implementations of my product are very hygienic as they are single use, disposable items. No storage of soiled material is necessary. They are, preferably, made of an environmentally friendly renewable resource that is biodegradable and compostable. This results in a product that is environmentally responsible not only in manufacturing but also in consumption.

These and other advantages of the present invention will be evident upon a review of the application including the specification, drawing, and claims.

DETAILED DESCRIPTION OF THE INVENTION

The present invention relates to a method, system and apparatus for an environmentally-friendly disposable product and method that permits a caretaker to easily deploy and accurately position the product with confidence that the product is hygienic, effective in efficiently protecting the caretaker's clothing, and resistant to repositioning. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
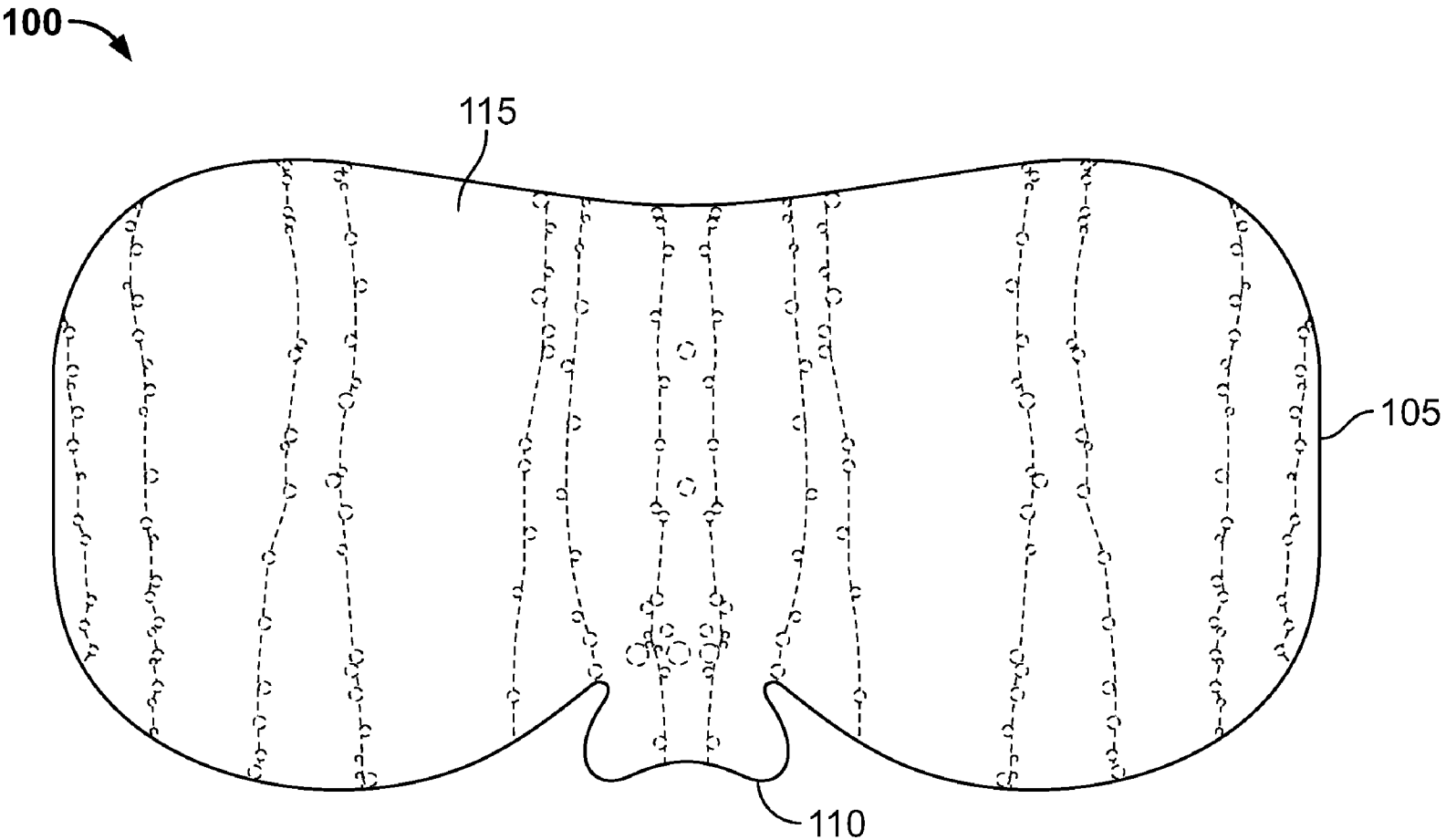
FIG. 1 is an overhead view of a device.

FIG. 1 is an overhead view of a device 100. Device 100 is an environmentally-friendly disposable product and method that permits a caretaker to easily deploy and accurately position the product with confidence that the product is hygienic, effective in efficiently protecting the caretaker's clothing, and resistant to repositioning. Device 100 has application in many different contexts including childcare, health care (e.g., hospitals, medical clinics, nursing care facilities, senior citizen homes and the like), food service, daycare facilities, restaurants, dental health care (e.g., dental schools, dental offices and the like), other childcare products including, for example, ear wash cloths, dental bibs, diaper/clothing changing pad, toddler bib, doctor/medical consultation pad, food mat, and other scenarios as is evident upon an understanding of the present invention and its applications. To simplify the discussion and aid in understanding the present invention, the present invention will be described in the context of childcare in general and use in burping babies in particular. However it is understood that the present invention (as described or with modifications) may be adapted to these other contexts. In the present context, device 100 includes a "burp" cloth implementation and is most preferably designed for disposable, single-use burping of an infant.

Device 100 of this implementation includes a disposable, contoured paper like device to absorb liquid and small solid material from oral discharge. With device 100, it is no longer necessary for a caretaker to carry an unhygienic soiled cloth that also requires laundering. The biodegradable and compostable properties of the material also make embodiments of this invention an environmentally friendly option. Disposal of this product will have limited impact on our environment.

Device 100 includes a body element 105 and a tab 110. Body element 105 preferably includes an elongate shape having two end portions (e.g., a front portion for a front of the torso and a rear portion for a back of the torso) joined together by an intermediate portion with the end portions being wider than the intermediate portion.

Body element 105 is desirably soak proof while being absorbent to absorb liquids relatively quickly. Body element 105 is preferably manufactured to be biodegradable and compostable, more preferably from plant fiber and most preferably from non-tree fiber. One preferred material for body element 105 includes use of bagasse, a fibrous residue left over after sugar cane has been crushed and sugar extracted. Other renewable, non-tree plant fibers may be used, including those obtained from bamboo and the like. Device 100 may be made of alternate materials and may, in some implementations, include plastic, traditional fabric cloth, and conventional wood pulp paper. These alternatives are less desirable because: plastic is typically non-biodegradable, petroleum derived and, pollution causing; wood pulp paper requires extensive use of trees and, hence, has significant impact on our forests; and fabric would not be used as recyclable or disposable for single use.

Body element 105 is preferably shaped for "saddling" (draping) over a shoulder of a caretaker. The top of the shoulder and significant portions of the front and back of the torso near the shoulder are covered. A preferred shape includes a kidney-shaped or C-shaped implementation. The front and rear portions are about 10-14 inches wide and body element 105 is about 18-22 inches long. Other implementations may be designed to have different dimensions relevant to anticipated uses of device 100 without departing from the spirit of the present invention. The shape of body element 105 is designed around the contours of the human shoulders and neck region. It is designed to drape over the shoulder, the chest, and the back areas creating a saddle-like design while curving around the base of the neck. This shape and construction protects the underlying clothing from being soiled by oral discharge or other bodily fluids. The size of the coverage area is based on typical adult sizes. The symmetric shape of body element 105 allows placement over either the left or right shoulder.

Tab 110 is a preferred implementation of a retentive element coupled to body element 105. Tab 110 is designed to be located near a base of a neck of the caretaker when device 100 is deployed. Typically the caretaker will be wearing some article of clothing on the upper body and that article of clothing often includes a neckline. The neckline may be simple, as in a T-shirt or the like, it may be a simple low collar like a dress shirt or blouse, or it may include a high collar like a turtleneck. Tab 110 advantageously interacts with any of these collar types as a retentive element. For T-shirts and low collar apparel, tab 110 is foldable down under the neckline. For high collars, tab 110 is foldable up under the neckline. In each case, tab 110 engages the neckline and helps device 100 resist unintended repositioning of body element 105 relative to the shoulder of the caretaker.

Body element 105 is the structure that absorbs the saliva/oral fluids and protects the clothing from becoming soiled by being saddled or draped over the shoulder, between the infant and the clothing. Tab 110 aids in retaining body element 105 in place. Other embodiments may employ different or additional retentive elements. Tab 110 may be made of the same material as body element 105 by reshaping the inner contour of the intermediate portion as an extension. Tab 110 may also be a separate element that is made of the same or similar (biodegradable and compostable) material and implemented as a projection from a similar position from the inner contour of body element 105. This projection would be attached to body element 105, preferably with a biodegradable adhesive. In some implementations, the retentive element may be a textural element on an underside of body element 105 to create a nonslip surface, in addition to or supplementing tab 110. In the preferred element, tab 110 also includes a releasable, lightly tacking adhesive that may be used to help retain device 100 in place and/or seal device closed after use, as further explained below.

It is one preferred feature of the present to recognize that a caretaker may need or desire to deploy device 100 in a public venue. The appearance of device 100 may be improved by changing the coloration, pattern or, texture by printing or embossing of an exposed top surface 115. This will improve the product esthetically and provide the consumers more choices to suit their personal needs and tastes. (An example of a pattern is shown in dashed lines in FIG. 1.)

Early in its history, bagasse processing was more difficult and a manufacturer making paper from non-tree fiber, like bagasse, needed specialized research and development and experience in operating advanced papermaking facilities. The manufacture of paper-like materials from non-tree fibers is more commonplace and routine and bagasse may now be processed in a relatively straight-forward manner to produce a product that is sanitary, absorbent, and soak-proof.

Figure 2:
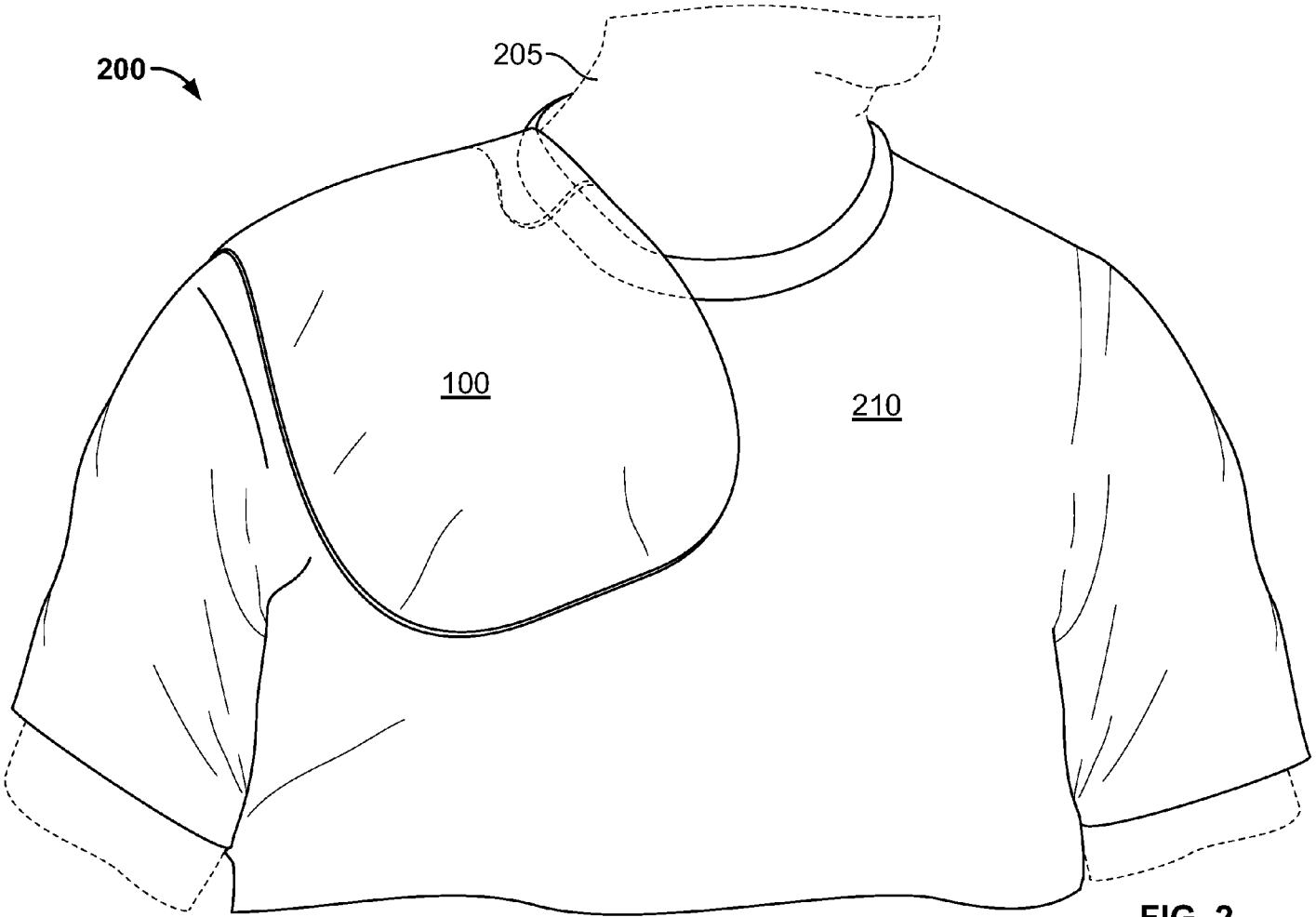
FIG. 2 is a stylized front view of the device from FIG. 1 deployed on a caretaker.
Figure 3:
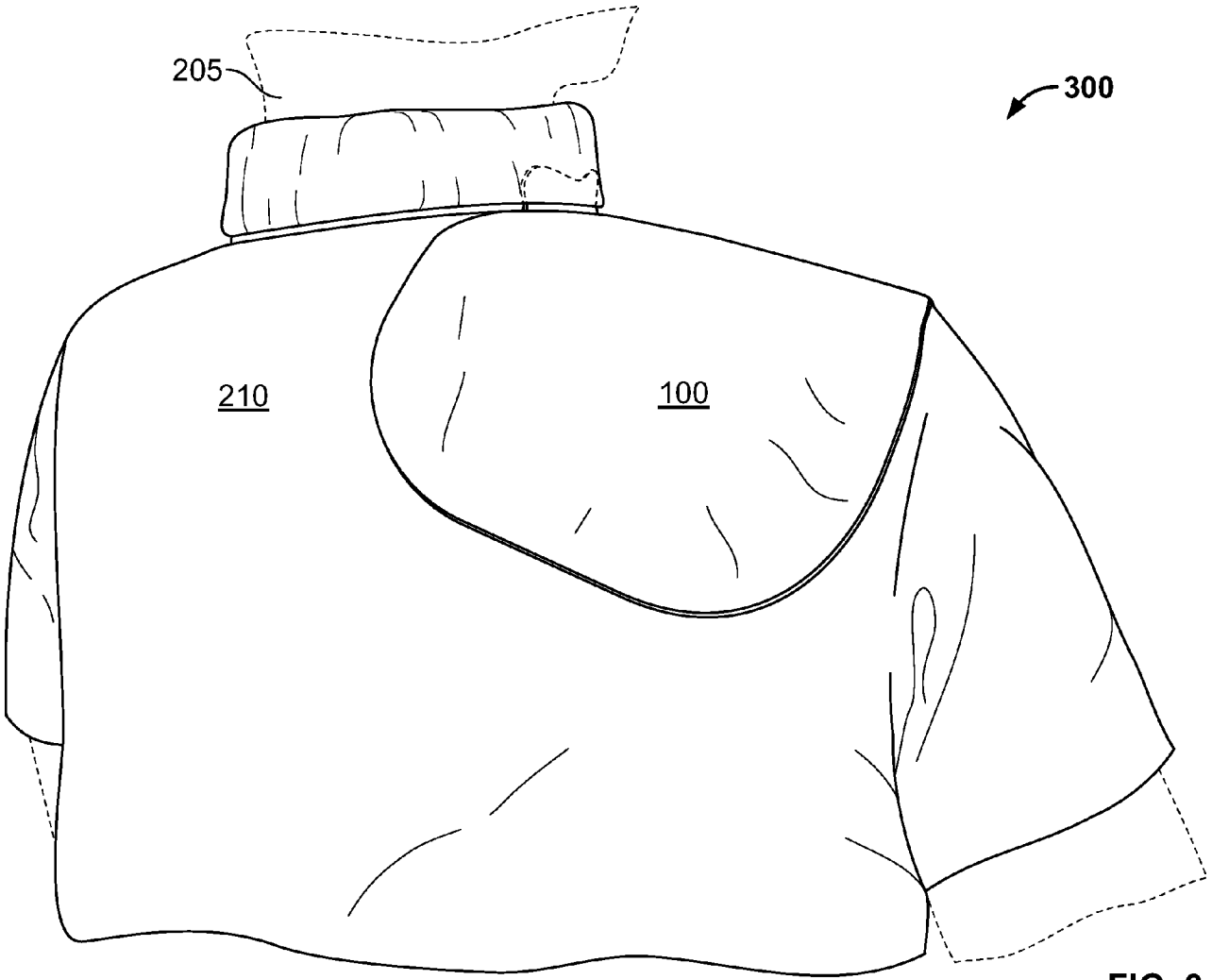
FIG. 3 is a stylized rear view of the device from FIG. 1 deployed on the caretaker shown in FIG. 2.
Figure 4:
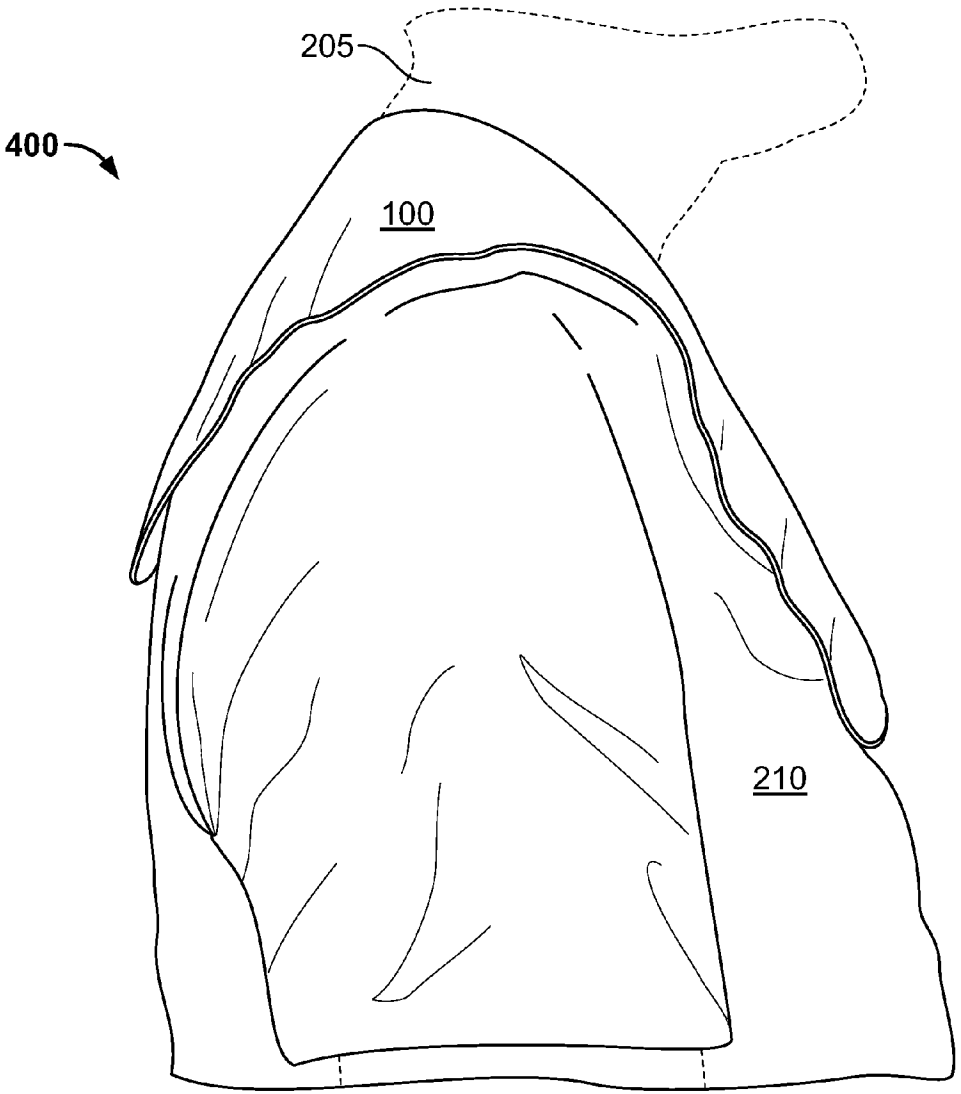
FIG. 4 is a stylized side view of the device from FIG. 1 deployed on the caretaker shown in FIG. 2 and FIG. 3.

FIG. 2 is a stylized front view 200 of device 100 from FIG. 1 deployed on a caretaker 205, FIG. 3 is a stylized rear view of device 100 deployed on caretaker 205, and FIG. 4 is a stylized side view 400 of device 100 deployed on caretaker 205. Caretaker 205 wears an article of clothing 210 that covers a portion of a shoulder and device 100 is deployed over the shoulder and protects clothing 210. Note that in FIG. 2, clothing 210 includes a low neckline and tab 110 is shown folded down inside the neckline to resist repositioning of device 100. In FIG. 3, clothing 210 includes a high neckline and tab 110 is shown folded up inside the neckline to resist repositioning of device 100. In a preferred implementation, each device 100 is folded and individually wrapped to be compact, sanitary, clean, and available for use. The following is a representative process flow for use of device 100, though the order and composition of the steps may vary in some implementations.

Caretaker 205 unwraps device 100 from its packaging. Caretaker 205 next unfolds device 100 and locates the retentive element (e.g., tab 110). Caretaker 205 deploys device over either shoulder with tab 110 positioned near the base of the neck. Tab 110 is folded inside the neck collar of clothing 210 to secure device 100 in place. Tab 110, as discussed above, may be folded down or up depending upon the style of the neckline. In some implementations, tab 110 may be provided with an external releasable adhesive for tacking tab 110 directly to clothing 210, and thus securing device 100, in place. Caretaker 205 then positions, straightens, and smoothes front and rear portions of body element 105. The caretaker places a child in a position conducive to gas expulsion (e.g., holding the infant up to the protected shoulder, with the baby's stomach resting on the caretaker's chest) and then lightly pats the child on its lower back so that it burps. It is not uncommon for this burping to result in vomiting or other oral discharge. The oral discharge and liquids are absorbed by, and the small solid material is caught by, device 100 which reduces potential contamination of clothing 210.

Afterwards, caretaker 205 may simply remove soiled device 100 by lifting tab 110 from out of the neckline (or releasing the adhered tab as appropriate), folding body element 105 inward towards exposed surface 115 and use the adhesive on tab 110 to close and lock device 100 closed. Caretaker 205 then disposes of device 110 in a compost, recycling, or trash collection, as appropriate. A new device 100 may be used as necessary or desired.

The preferred embodiments have been described in the context of a burp cloth for young children. As noted herein, the present invention may be adapted for other contexts where a caretaker has oral discharges and/or bodily fluids, sometimes associated with small solid material, to manage.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A biofriendly burpcloth apparatus for overlaying a shoulder of a user wearing a garment over a torso of the user, comprising:

a generally elongate absorbent soak-resistant single-use body element including a front portion, a rear portion and an intermediate portion joining said front portion to said rear portion, said body element configured for collecting and protecting against regurgitated stomach contents and for lateral deployment over the shoulder with said intermediate portion disposed on top of the shoulder having said front portion overlaying a portion of a chest of the user and having said rear portion overlaying a portion of a back of the user wherein said body element consists essentially of a plurality of fibers derived from supporting tissue for a plant made into a paper-like material; and a retentive element coupled to said intermediate portion of said body element, said retentive element including a foldable tab with said tab engaging the garment proximate a neck of the user to resist displacement of said body element after said body element is deployed over the shoulder;

wherein said tab is configurable for multi-mode operation depending upon a type of a neckline of the garment, said tab upwardly foldable to engage up under said neckline when the garment includes high neckline collar and said tab downwardly foldable to engage down under said neckline collar when the garment includes either of a no neckline collar or a low neckline collar;

wherein said tab includes an external releasable adhesive for tacking said tab directly to the garment and for closing and locking a folded body element in a closed position.

2. A biofriendly burpcloth apparatus for overlaying a shoulder of a user wearing a garment over a torso of the user, comprising:

a generally elongate absorbent soak-resistant single-use body element including a front portion, a rear portion and an intermediate portion joining said front portion to said rear portion, said body element configured for collecting and protecting against regurgitated stomach contents and for lateral deployment over the shoulder with said intermediate portion disposed on top of the shoulder having said front portion overlaying a portion of a chest of the user and having said rear portion overlaying a portion of a back of the user wherein said body element consists essentially of a plurality of fibers derived from supporting tissue for a plant made into a paper-like material; and a retentive element coupled to said intermediate portion of said body element, said retentive element including a foldable tab with said tab engaging the garment proximate a neck of the user to resist displacement of said body element after said body element is deployed over the shoulder;

wherein said tab is configurable for multi-mode operation depending upon a type of a neckline of the garment, said tab upwardly foldable to engage up under said neckline when the garment includes high neckline collar and said tab downwardly foldable to engage down under said neckline collar when the garment includes either of a no neckline collar or a low neckline collar;

wherein said body element is contoured wherein said front portion and said rear portion each have a width greater than said intermediate portion; and wherein said body element is generally kidney shaped and includes a pair of generally rounded lobes, said lobes corresponding to one of said front and back portions and wherein said widths correspond to a width of said lobes.

3. The burpcloth of claim 2 wherein said body element includes a length in a range of about 18-22 inches and wherein each of said lobes has a width in a range of about 10-14 inches.

* * * * *